US011441212B2

(12) United States Patent
Takashita et al.

(10) Patent No.: US 11,441,212 B2
(45) **Date of Patent: *Sep. 13, 2022**

(54) ALLOYED STEEL POWDER

(71) Applicant: JFE STEEL CORPORATION, Tokyo (JP)

(72) Inventors: Takuya Takashita, Tokyo (JP); Akio Kobayashi, Tokyo (JP); Naomichi Nakamura, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 161 days.

This patent is subject to a terminal disclaimer.

(21) Appl. No.: 16/769,240

(22) PCT Filed: Nov. 30, 2018

(86) PCT No.: PCT/JP2018/044315

§ 371 (c)(1),
(2) Date: Jun. 3, 2020

(87) PCT Pub. No.: WO2019/111833

PCT Pub. Date: Jun. 13, 2019

(65) Prior Publication Data

US 2021/0180164 A1 Jun. 17, 2021

(30) Foreign Application Priority Data

Dec. 5, 2017 (JP) ..... JP2017-233215

(51) Int. Cl.

| | |
|---|---|
| ***C22C 38/12*** | (2006.01) |
| ***C22C 38/04*** | (2006.01) |
| ***C22C 38/16*** | (2006.01) |
| ***B22F 1/00*** | (2022.01) |
| ***C22C 33/02*** | (2006.01) |
| ***B22F 1/05*** | (2022.01) |

(52) U.S. Cl.
CPC ..... *C22C 38/12* (2013.01); *B22F 1/05* (2022.01); *C22C 33/0207* (2013.01); *C22C 38/04* (2013.01); *C22C 38/16* (2013.01); *B22F 2201/013* (2013.01)

(58) Field of Classification Search
None
See application file for complete search history.

(56) References Cited

U.S. PATENT DOCUMENTS

| | | | |
|---|---|---|---|
| 5,462,577 A | 10/1995 | Ogura et al. | |
| 6,758,882 B2 | 7/2004 | Nakamura et al. | |
| 7,347,884 B2 | 3/2008 | Unami et al. | |
| 7,384,446 B2 | 6/2008 | Unami et al. | |
| 10,207,328 B2 | 2/2019 | Takashita et al. | |
| 10,265,766 B2 | 4/2019 | Maetani et al. | |
| 2007/0089562 A1* | 4/2007 | Unami | C22C 33/0207 75/255 |
| 2016/0214171 A1 | 7/2016 | Maetani et al. | |
| 2018/0178291 A1 | 6/2018 | Takashita et al. | |
| 2018/0193911 A1 | 7/2018 | Kobayashi et al. | |
| 2021/0138547 A1* | 5/2021 | Takashita | C22C 38/16 |

FOREIGN PATENT DOCUMENTS

| | | | |
|---|---|---|---|
| CN | 1104570 | A | 7/1995 |
| CN | 100449024 | C | 1/2009 |
| CN | 100515613 | C | 7/2009 |
| CN | 105263653 | A | 1/2016 |
| CN | 105555440 | A | 5/2016 |
| JP | S5645966 | B2 | 10/1981 |
| JP | S59129753 | A | 7/1984 |
| JP | 561295302 | A | 12/1986 |
| JP | H01123001 | A | 5/1989 |
| JP | H0247202 | A | 2/1990 |
| JP | H059501 | A | 1/1993 |
| JP | H07157803 | A | 6/1995 |
| JP | H07188714 | A | 7/1995 |
| JP | 2002146403 | A | 5/2002 |
| JP | 2002348601 | A | 12/2002 |
| JP | 2003247003 | A | 9/2003 |
| JP | 2005330573 | A | 12/2005 |
| JP | 2014237878 | A | 12/2014 |
| JP | 2015014048 | A | 1/2015 |
| KR | 1020170080668 | A | 7/2017 |
| WO | 2005102564 | A1 | 11/2005 |

(Continued)

OTHER PUBLICATIONS

Mar. 19, 2021, Office Action issued by the Korean Intellectual Property Office in the corresponding Korean Patent Application No. 10-2020-7018382 with English language concise statement of relevance.

Mar. 30, 2021, Communication pursuant to Article 94(3) EPC issued by the European Patent Office in the corresponding European Patent Application No. 18887066.1.

Mohammad Momeni, Temperature and Interstitial Effects on Physical and Chemical Processes During Sintering of Ferrous Powder Compacts, 2010, pp. 67, 68, 74,168, Vienna University of Technology.

(Continued)

*Primary Examiner* — Xiaowei Su

(74) *Attorney, Agent, or Firm* — Kenja IP Law PC

(57) ABSTRACT

Provided is alloyed steel powder having excellent fluidity, formability, and compressibility without containing Ni, Cr, or Si. The alloyed steel powder includes iron-based alloy containing Mo, in which Mo content is 0.4 mass % to 1.8 mass %, a weight-based median size D50 is 40 μm or more, and among particles contained in the alloyed steel powder, those particles having an equivalent circular diameter of 50 μm to 200 μm have a number average of solidity of 0.70 to 0.86, the solidity being defined as (particle cross-sectional area/envelope-inside area).

4 Claims, No Drawings

(56) References Cited

FOREIGN PATENT DOCUMENTS

| | | | |
|---|---|---|---|
| WO | 2015045273 | A1 | 4/2015 |
| WO | 2016088333 | A1 | 6/2016 |
| WO | 2017043094 | A1 | 3/2017 |
| WO | 2017047101 | A1 | 3/2017 |

OTHER PUBLICATIONS

Dec. 17, 2019, Notification of Reasons for Refusal issued by the Japan Patent Office in the corresponding Japanese Patent Application No. 2019-510986 with English language Concise Statement of Relevance.

Feb. 5, 2019, International Search Report issued in the International Patent Application No. PCT/JP2018/044315.

Sep. 3, 2021, Office Action issued by the China National Intellectual Property Administration in the corresponding Chinese Patent Application No. 201880078188.8 with English language search report.

Jul. 28, 2020, the Extended European Search Report issued by the European Patent Office in the corresponding European Patent Application No. 18887066.1.

Jun. 22, 2021, Office Action issued by the Canadian Intellectual Property Office in the corresponding Canadian Patent Application No. 3,084,316.

* cited by examiner

ALLOYED STEEL POWDER

TECHNICAL FIELD

This disclosure relates to an alloyed steel powder and, in particular, to an alloyed steel powder having excellent fluidity, formability, and compressibility without containing Ni, Cr, and Si.

BACKGROUND

Powder metallurgical techniques enable manufacture of complicated-shape parts with dimensions very close to the products' shapes (i.e. near net shapes) and with high dimensional accuracy. The use of powder metallurgical techniques in manufacturing parts therefore can significantly reduce machining costs. For this reason, powder metallurgical products manufactured by powder metallurgical techniques have been used as various mechanical parts in many fields. Further, to cope with demands for reductions in size and weight and increasing complexity of parts, requirements for powder metallurgical techniques are becoming more stringent.

Against the above background, requirements for alloyed steel powder used in powder metallurgy are also becoming more rigorous. For example, to ensure workability in filling a press mold with alloyed steel powder for powder metallurgy and forming the alloyed steel powder, alloyed steel powder is required to have excellent fluidity.

Further, sintered parts obtained by sintering alloyed steel powder are required to have excellent mechanical properties. Therefore, the improvement of compressibility is required for ensuring fatigue strength and the improvement of formability is required for preventing chipping of complicated-shape parts.

Moreover, a reduction in costs for manufacturing parts is strongly required, and from such a viewpoint, alloyed steel powder is required to be manufactured in an existing powder manufacturing process without the need of any additional step. Further, although elements for improving quench hardenability are typically added as alloy components to alloyed steel powder for powder metallurgy, alloyed steel powder not containing Ni, which is highest in alloy costs, is required.

As alloyed steel powder not containing Ni, alloyed steel powder added with at least one of Mo, Cr, Si, or Cu is widely used. However, among these elements, Cr and Si have the problem of being oxidized under a RX gas (endothermic converted gas) atmosphere which is typically used as an atmosphere gas for sintering in a sintered part manufacturing process. Therefore, in sintering a formed body manufactured using alloyed steel powder containing Cr or Si, sintering needs to be performed under high-level atmosphere control using $N_2$ or $H_2$. As a result, even if a raw material cost can be reduced by not using Ni, a part manufacturing cost is increased and eventually, a total cost cannot be reduced.

In light thereof, the recent requirements for alloyed steel powder are as follows:

(1) excellent fluidity;
(2) good compressibility;
(3) high formability; and
(4) low cost.

Among alloyed steel powder for powder metallurgy, Mo-based alloyed steel powder in which Mo is used as an element for improving quench hardenability has no concern of oxidation that would occur in the case of using Cr or Si as described above, and the decrease in compressibility through the addition of the element is small. Thus, the Mo-based alloyed steel powder is suitable for parts having high compressibility and complicated shapes. Further, since Mo has even better quench hardenability than Ni, excellent quench hardenability can be exhibited even through the addition of a trace amount of Mo. For the above reason, the Mo-based alloyed steel powder is considered to be the most suitable alloy for satisfying the requirements (1) to (4).

As to techniques with regard to the Mo-based alloyed steel powder, for example, JP 2002-146403 A (PTL 1) proposes an alloyed steel powder having excellent compressibility and cold forgeability in which 0.2 mass % to 10.0 mass % Mo is diffusionally adhered to the surface of an iron-based powder containing Mn.

Meanwhile, for improving the formability, various efforts are made as described below with regard to non-Mo-based alloyed steel powder.

JP H05-009501 A (PTL 2) describes a technique related to Fe—Si—Mn—C-based alloyed steel powder from which a sintered body suitable for quench-hardened members and the like is obtained. The alloyed steel powder has a rattler value as significantly low and good as 0.31% when formed under a pressure of 6 t/cm$^2$, the rattler value being an index of formability.

JP H02-047202 A (PTL 3) describes a technique related to alloyed steel powder obtained by partially diffusing Ni on iron-based powder, and the alloyed steel powder indicates a rattler value as good as 0.4% when formed under a pressure of 6 t/cm$^2$.

JP S59-129753 A (PTL 4) describes a technique related to Fe—Mn—Cr-based alloyed steel powder subjected to vacuum reduction, and the alloyed steel powder has a rattler value as good as 0.35% when formed under a pressure of 6 t/cm$^2$.

JP 2002-348601 A (PTL 5) describes a technique of setting the rattler value to a significantly low value of about 0.2% to 0.3% by applying a copper coating to the surface of iron powder.

CITATION LIST

Patent Literature

PTL 1: JP 2002-146403 A
PTL 2: JP H05-009501 A
PTL 3: JP H02-047202 A
PTL 4: JP S59-129753 A
PTL 5: JP 2002-348601 A

SUMMARY

Technical Problem

However, the conventional techniques described in PTL 1 to PTL 5 have the following problems.

The alloyed steel powder proposed in PTL 1 has excellent compressibility and cold forgeability. However, PTL 1 merely defines the composition of alloyed steel powder. Further, although PTL 1 mentions compressibility, no specific study is made on formability. Thus, the alloyed steel powder proposed in PTL 1 does not satisfy the requirement (3).

On the other hand, although the alloyed steel powder described in PTL 2 has excellent formability, it contains Si and thus needs to be sintered in a specially controlled atmosphere in order to prevent the oxidation of Si described above, thus not satisfying the requirement (4). Further, the alloyed steel powder described in PTL 2 has poor compressibility and a green compact obtained by forming the alloyed steel powder has an extremely low density of 6.77 g/cm$^3$ with a forming pressure of 6 Vern'. A green compact having this low density is of concern in terms of fatigue strength. Therefore, the alloyed steel powder described in PTL 2 does not satisfy the requirements (2) and (4).

Further, the alloyed steel powder described in PTL 3 needs to contain Ni in an amount as large as 30 mass %, and thus does not satisfy the requirement (4).

Similarly, since the alloyed steel powder described in PTL 4 also needs to contain Cr, the atmosphere control during sintering is necessary, and thus the alloyed steel powder of PTL 4 does not satisfy the requirement (4).

The alloyed steel powder described in PTL 5 needs an additional step in the manufacturing process of raw material powder, that is, applying coating to powder. Further, the amount of Cu used for coating is 20 mass % or more, which is significantly large amount compared with the Cu content in common sintered steel (about 2 mass % to 3 mass %), and as a result, alloyed steel powder costs are increased. Therefore, the alloyed steel powder described in PTL 5 does not satisfy the requirement (4).

As described above, the conventional techniques as described in PTL 1 to PTL 5 cannot produce alloyed steel powder which satisfies all the requirements (1) to (4).

It could thus be helpful to provide an alloyed steel powder having excellent fluidity, formability, and compressibility without containing Ni, Cr, and Si.

Solution to Problem

The inventors made intensive studies and discovered that the above-described issues can be addressed by the features described below, and this disclosure was completed based on this discovery. Specifically, the features of this disclosure are as follows.

1. An alloyed steel powder comprising iron-based alloy containing Mo, wherein the Mo content is 0.4 mass % to 1.8 mass %, a weight-based median size D50 is 40 μm or more, and among particles contained in the alloyed steel powder, those particles having an equivalent circular diameter of 50 μm to 200 μm have a number average of solidity of 0.70 to 0.86, the solidity being defined as (particle cross-sectional area/envelope-inside area).

2. The alloyed steel powder according to 1, wherein the iron-based alloy contains Ni, Cr, and Si each in an amount of 0.1 mass % or less.

3. The alloyed steel powder according to 1. or 2, wherein the iron-based alloy contains one or both of Cu and Mn.

Advantageous Effect

The alloyed steel powder disclosed herein has excellent fluidity, formability, and compressibility without containing Ni, Cr, and Si. Further, since it is not necessary to contain Ni contributing to a high alloy cost and Cr and Si requiring annealing under a special atmosphere, and an additional manufacturing step such as coating is not necessary, the alloyed steel powder of this disclosure can be manufactured in an existing powder manufacturing process at a low cost.

DETAILED DESCRIPTION

Detailed description is given below. The following merely provides preferred embodiments of this disclosure, and this disclosure is by no means limited to the description.

[Alloyed Steel Powder]

The alloyed steel powder of this disclosure is composed of iron-based alloy containing Mo. The term "iron-based alloy" indicates alloy containing Fe in an amount of 50 mass % or more. Therefore, in other words, the alloyed steel powder of this disclosure is iron-based alloyed powder containing Mo. The alloyed steel powder of this disclosure may be pre-alloyed steel powder.

In this disclosure, it is important to control the Mo content, the median size, and the number average of the solidity within the above ranges. The reasons for limiting the items are described below.

Mo content: 0.4 mass % to 1.8 mass %

The alloyed steel powder of this disclosure contains Mo as an essential alloying element. Containing Mo as an element forming an α phase can accelerate sintering diffusion. Further, Mo has an effect of stabilizing secondary particles formed by heat treatment through α phase sintering. In this disclosure, to stabilize the secondary particles and control the solidity within the range described below, the Mo content in iron-based alloy constituting the alloyed steel powder is 0.4 mass % or more. The Mo content is preferably 0.5 mass % or more and more preferably 0.6 mass % or more. On the other hand, when the Mo content exceeds 1.8 mass %, the sintering accelerating effect reaches a plateau, causing a decrease in compressibility. Therefore, the Mo content in the iron-based alloy is 1.8 mass % or less. The Mo content is preferably 1.7 mass % or less and more preferably 1.6 mass % or less.

The chemical composition other than the Fe and Mo contents of the alloyed steel powder of this disclosure is not particularly limited and may be freely formulated. The Fe content may be 50 mass % or more but is preferably 80% or more, more preferably 90% or more, and further preferably 95% or more. On the other hand, no upper limit is placed on the Fe content. For example, the chemical composition of the iron-based alloy may contain Mo: 0.4% to 1.8% with the balance being Fe and inevitable impurities.

Examples of the inevitable impurities include C, O, N, S, and P. It is noted that by reducing the contents of inevitable impurities, it is possible to further improve the compressibility of the powder and to obtain an even higher forming density. Therefore, the C content is preferably 0.02 mass % or less. The O content is preferably 0.3 mass % or less and more preferably 0.25 mass % or less. The N content is preferably 0.004 mass % or less. The S content is preferably 0.03 mass % or less. The P content is preferably 0.1 mass % or less.

The iron-based alloy may optionally contain an additional alloying element. As the additional alloying element, for example, one or both of Cu and Mn may be used. Note that Mn is oxidized during sintering as with Si and Cr, excessive addition of Mn deteriorates the properties of a sintered body. Therefore, the Mn content in the alloyed powder is preferably 0.5 mass % or less. Further, excessive addition of Cu lowers the compressibility of the powder as with Mo. Therefore, the Cu content is preferably 0.5 mass % or less.

The alloyed steel powder of this disclosure does not need to contain Ni, Cr, and Si, which are conventionally used. Since Ni leads to an increased alloy cost, the Ni content in the entire alloyed steel powder is preferably set to 0.1 mass % or less, and it is more preferable that the alloyed steel powder does not substantially contain Ni. Further, as described above, since Cr is easily oxidized and requires the control of an annealing atmosphere, the Cr content in the entire alloyed steel powder is preferably set to 0.1 mass % or less, and it is more preferable that the alloyed steel powder does not substantially contain Cr. For the same reason as Cr, the Si content in the entire alloyed steel powder is preferably set to 0.1 mass % or less, and it is more preferable that the alloyed steel powder does not substantially contain Si. The expression "not substantially contain" means that an element is not contained except as an inevitable impurity, and it is thus acceptable that the element may be contained as an inevitable impurity.

D50: 40 μm or more

When the alloyed steel powder has a weight-based median size D50 (hereinafter, simply referred to as "D50") of less than 40 μm, the ratio of fine particles within the entire alloyed steel powder becomes too high, resulting in lower compressibility. Therefore, D50 is 40 μm or more. D50 is preferably 65 μm or more. Although no upper limit is placed on D50, excessively large D50 deteriorates the mechanical properties after sintering. Therefore, considering the properties after sintering, D50 is preferably 120 μm or less.

The maximum particle size of the alloyed steel powder is not particularly limited, yet it is preferably 212 μm or less. As used herein, the maximum particle size of 212 μm or less means that the alloyed steel powder is a powder passing through a sieve having an opening size of 212 μm.

Solidity: 0.70 to 0.86

In the alloyed steel powder of this disclosure, it is important that among particles contained in the alloyed steel powder, those particles having an equivalent circular diameter of 50 μm to 200 μm have a number average of solidity of 0.70 or more and 0.86 or less, the solidity being defined as (particle cross-sectional area/envelope-inside area). In the following description, the number average of the solidity of particles having an equivalent circular diameter of 50 μm to 200 μm, the solidity being defined as (particle cross-sectional area/envelope-inside area), is referred to simply as "solidity".

The solidity is an index indicating the roughness degree of a particle surface. A lower solidity indicates a higher roughness degree of a particle surface. By setting the solidity to 0.86 or less, the entanglement between particles during forming is promoted, and as a result, the formability is improved. The solidity is preferably set to 0.85 or less, and more preferably 0.83 or less. On the other hand, an excessively low solidity lowers the fluidity of the powder. Therefore, the solidity is 0.70 or more.

Similar indexes include the particle circularity, which is lowered not only by an increase in the roughness of a particle surface but also by elongation of a particle in a needle shape. Since elongated particles do not contribute to the improvement of the formability, the particle circularity is not suitable as the index of the formability.

The solidity can be obtained by image interpretation of the projected images of the particles. Devices that can calculate the solidity include Morphologi G3 available from Malvern Panalytical and CAMSIZER X2 available from Verder Scientific Co., Ltd. and any of these devices can be used. Further, in measuring the solidity, at least 10,000 particles, preferably 20,000 particles are measured to calculate the solidity as the number average of these particles.

[Production Method]

Next, a method of producing the alloyed steel powder according to the present disclosure will be described. The alloyed steel powder disclosed herein is obtainable by subjecting raw material powder with controlled chemical composition and particle size distribution to heat treatment, followed by grinding and classification.

[Raw Material Powder]

The chemical composition of the raw material powder may be adjusted so that the chemical composition of the resulting alloyed steel powder satisfies the above conditions. Typically, the chemical composition of the raw material powder may be the same as that of the alloyed steel powder. For example, the raw material powder may be produced by preparing molten steel whose chemical composition is adjusted in advance so as to satisfy the above conditions and subjecting the molten steel to an arbitral method.

As the raw material powder, atomized alloyed steel powder produced by the atomizing method in which alloying elements are easily adjusted is preferably used, and water-atomized alloyed steel powder produced by the water atomizing method which is low in manufacturing costs among atomizing methods and enables efficient mass production of alloyed steel powder is more preferably used.

The average particle size of the raw material powder is not particularly limited. Since the raw material powder after subjecting to heat treatment has an average particle size substantially equivalent to that of the raw material powder, from the viewpoint of suppressing a reduction in the yield rate in the subsequent step such as sieving, it is preferable to use the one with a particle size close to that of alloyed steel powder to be produced.

Further, the number frequency of particles having a particle size of 20 μm or less in the entire raw material powder is set to 60% or more. When the number frequency is set to 60% or more, secondary particles in which fine raw material powder having a particle size of 20 μm or less are attached to the surface of another raw material powder are formed, and as a result, the solidity can be set to 0.86 or less. On the other hand, when the number frequency of fine powder having a particle size of 20 μm or less is excessively high, D50 of the alloyed steel powder after heat treatment decreases. Thus, the number frequency is set to 90% or less.

Measuring methods of the number frequency include a laser diffraction method and an image interpretation method, any of which may be used. Raw material powder satisfying the above number frequency condition can be obtained by, for example, adjusting spray conditions for atomization. Further, such raw material powder can be obtained by mixing particles having a particle size of beyond 20 μm and particles having a particle size of 20 μm or less.

The maximum particle size of the raw material powder is not particularly limited, yet it is preferably 212 μm or less. As used herein, a maximum particle size of 212 μm or less means that the raw material powder passes through a sieve having an opening size of 212 μm.

[Heat Treatment]

Next, the raw material powder is subjected to heat treatment. The raw material powder produced by the atomizing method typically contains oxygen and carbon, and thus has low compressibility and sinterability. The oxide and carbon contained in the powder can be excluded through deoxidation and decarburization by heat treatment, which makes it possible to improve the compressibility and sinterability of the alloyed steel powder.

As the atmosphere of the heat treatment, a reducing atmosphere, in particular, a hydrogen atmosphere is suitable. The heat treatment may be performed under vacuum. The temperature of the heat treatment is preferably in a range of 800° C. to 1100° C. If the temperature of the heat treatment is lower than 800° C., reduction of oxygen is insufficient. On the other hand, if the temperature of the heat treatment is higher than 1100° C., the sintering of the powder excessively proceeds during the heat treatment, resulting in an increase of the solidity. In performing decarburization, the dew point of the atmosphere during the heat treatment is preferably 20° C. or higher. However, since a dew point higher than 70° C. inhibits the deoxidation by hydrogen, the dew point is preferably 70° C. or lower.

When the heat treatment is performed as described above, the resulting raw material powder is normally in a state of being sintered and agglomerated. Therefore, the powder is ground and classified into desired particle sizes. Specifically, coarse powder is removed by additional grinding or classification using a sieve with predetermined openings according to need, to achieve a desired particle size.

[Manufacturing of Sintered Body]

The alloyed steel powder of this disclosure can be pressed and then sintered into a sintered body as with conventional powder for powder metallurgy.

In the case of performing pressing, it is possible to optionally add an auxiliary material to the alloyed steel powder. As the auxiliary material, for example, one or both of copper powder and graphite powder may be used.

In the pressing, it is also possible to mix the alloyed steel powder with a powder-like lubricant. Moreover, forming of the alloyed steel powder may be performed with a lubricant being applied or adhered to a mold used for the pressing. In either case, as the lubricant, any of metal soap such as zinc stearate and lithium stearate and amide-based wax such as ethylene bis stearamide may be used. In the case of mixing the lubricant, the amount of the lubricant is preferably about 0.1 parts by mass to 1.2 parts by mass with respect to 100 parts by mass of the alloyed steel powder.

The method of the pressing is not particularly limited, and may be any method as long as it enables forming of mixed powder for powder metallurgy. At this time, when the pressing force in the pressing is less than 400 MPa, the density of the resulting formed body (green compact) is lowered, and as a result, the properties of the resulting sintered body may be deteriorated. On the other hand, when the pressing force is more than 1000 MPa, the life of the press mold used for the pressing is shortened, which is economically disadvantageous. Therefore, the pressing force is preferably set to 400 MPa to 1000 MPa. Further, the temperature during the pressing is preferably set to normal temperature (20° C.) to 160° C.

The formed body thus obtained has high density and excellent formability. Further, since the alloyed steel powder disclosed herein does not require elements requiring the control of a sintering atmosphere control, such as Cr and Si, sintering can be performed in a conventional inexpensive process.

EXAMPLES

Although the present disclosure will be described below in further detail with reference to examples, the disclosure is not intended to be limited in any way to the following examples.

Example 1

Raw material powder samples having adjusted chemical composition and particle size distribution were prepared, and then subjected to heat treatment to thereby produce alloyed steel powder samples. The specific procedures were as follows.

First, as the raw material powder samples, various types of iron-based powder having different chemical compositions and particle sizes were prepared by the water atomizing method. The Mo content of each raw material powder sample is listed in Table 1. The Mo content of the raw material powder sample was equal to the Mo content of the corresponding resulting alloyed steel powder sample. The balance other than Mo was Fe and inevitable impurities. The raw material powder sample did not contain Ni, Cr, or Si excluding in its inevitable impurities, and thus, the content of each of Ni, Cr, and Si was 0.1 mass % or less.

The number frequency of particles having a particle size of 20 μm or less in the whole raw material powder sample is also listed in Table 1. The number frequency was measured by image interpretation using Morphologi G3 available from Malvern Panalytical.

Next, the raw material powder samples were subjected to heat treatment in a hydrogen atmosphere having a dew point of 30° C. (retention temperature: 880° C., retention time: 1 h) to obtain alloyed steel powder samples.

For each of the obtained alloyed steel powder samples, image interpretation was performed to measure the number average of the solidity of particles having an equivalent circle diameter of 50 μm to 200 μm. For the image interpretation, Malvern Morphologi G3 was used, as was the case with the raw material powder samples. Further, D50 of the alloyed steel powder sample was measured by sieving.

In addition, the fluidity of each obtained alloyed steel powder sample was evaluated. In the evaluation of fluidity, 100 g of each alloyed steel powder sample was dropped through a nozzle with a diameter of 5 mm, and those samples were judged as "passed" if the entire amount flowed through the nozzle without stopping, or "failed" if the entire or partial amount stopped and did not flow through the nozzle.

After adding 1 part by mass of zinc stearate as a lubricant with respect to 100 parts by mass of each alloyed steel powder sample, the resulting powder was formed to ϕ11 mm and 11 mm high under a forming pressure of 686 MPa to obtain a green compact. The density of each obtained green compact was calculated from its size and weight. The density of each green compact can be regarded as an index of the compressibility of the corresponding alloyed steel powder sample. From the viewpoint of compressibility, those samples having a density of 7.20 $Mg/m^3$ or higher are considered acceptable.

Then, in order to evaluate the formability, each green compact was subjected to a rattler test prescribed in JAPAN POWDER METALLURGY ASSOCIATION (JPMA) P 11-1992 to measure its rattler value. For rattler values, 0.4% or less is considered acceptable.

The measurement results are as listed in Table 1. From these results, it can be found that the alloyed steel powder samples satisfying the conditions of the present disclosure exhibited excellent fluidity, compressibility, and formability. Further, the alloyed steel powder according to the present disclosure neither needs to contain Ni contributing to a high alloy cost or Cr and S1 requiring annealing under a special atmosphere, nor to be subjected to any additional production step such as coating. Therefore, the alloyed steel powder according to the present disclosure can be produced by a conventional powder production process at a low cost.

TABLE 1

| No. | Raw material powder Number frequency of 20 μm or less (%) | Alloyed steel powder Mo content (mass %) | Solidity (—) | D50 (μm) | Fluidity | Green compact Compressibility Density ($Mg/m^3$) | Formability Rattler value (%) | Remarks |
|---|---|---|---|---|---|---|---|---|
| 1 | 50 | 0.6 | 0.89 | 75 | passed | 7.23 | 0.45 | Comparative Example |
| 2 | 60 | 0.6 | 0.86 | 73 | passed | 7.23 | 0.37 | Example |
| 3 | 65 | 0.6 | 0.83 | 70 | passed | 7.22 | 0.35 | Example |
| 4 | 68 | 0.6 | 0.81 | 65 | passed | 7.23 | 0.31 | Example |
| 5 | 80 | 0.6 | 0.76 | 50 | passed | 7.22 | 0.26 | Example |
| 6 | 63 | 0.6 | 0.84 | 120 | passed | 7.26 | 0.32 | Example |
| 7 | 65 | 0.6 | 0.85 | 100 | passed | 7.25 | 0.32 | Example |
| 8 | 64 | 0.6 | 0.84 | 90 | passed | 7.24 | 0.35 | Example |
| 9 | 65 | 0.6 | 0.82 | 50 | passed | 7.21 | 0.34 | Example |
| 10 | 68 | 0.6 | 0.82 | 40 | passed | 7.20 | 0.33 | Example |
| 11 | 68 | 0.6 | 0.82 | 30 | failed | 7.18 | 0.33 | Comparative Example |
| 12 | 64 | 0.2 | 0.91 | 66 | passed | 7.25 | 0.55 | Comparative Example |
| 13 | 65 | 0.4 | 0.86 | 67 | passed | 7.23 | 0.38 | Example |
| 14 | 66 | 0.5 | 0.84 | 67 | passed | 7.23 | 0.36 | Example |
| 15 | 65 | 1.0 | 0.83 | 66 | passed | 7.22 | 0.32 | Example |
| 16 | 67 | 1.1 | 0.82 | 68 | passed | 7.22 | 0.31 | Example |
| 17 | 65 | 1.4 | 0.81 | 65 | passed | 7.21 | 0.30 | Example |
| 18 | 64 | 1.6 | 0.81 | 68 | passed | 7.21 | 0.30 | Example |
| 19 | 65 | 1.8 | 0.81 | 67 | passed | 7.20 | 0.29 | Example |
| 20 | 65 | 2.2 | 0.79 | 68 | passed | 7.18 | 0.29 | Comparative Example |

Example 2

Alloyed steel powder samples were prepared under the same conditions as in Example 1, except for the use of iron-based powder (pre-alloyed steel powder) containing one or both of Cu and Mn in addition to Mo with the balance being Fe and inevitable impurities were used as the raw material powder samples. The iron-based powder was atomized iron-based powder produced by an atomizing method.

Table 2 lists the number frequency of particles having a particle size of 20 μm or less contained in the iron-based powder used. The number frequency was measured in the same way as in Example 1.

Next, the raw material powder samples were subjected to heat treatment under the same conditions as Example 1 to obtain alloyed steel powder samples. Each alloyed steel powder sample contained the same contents of Mo, Cu, and Mn as the corresponding raw material powder sample used, and the contents are as listed in Table 2.

For each of the obtained alloyed steel powder samples, image interpretation was performed to measure the number average of the solidity of particles having an equivalent circle diameter of 50 μm to 200 μm. The image interpretation was conducted in the same way as in Example 1. Further, D50 of each partially diffusion-alloyed steel powder sample was measured by sieving.

In addition, the fluidity of each obtained alloyed steel powder sample was evaluated. The evaluation of the fluidity was conducted in the same way as in Example 1.

After adding 1 part by mass of zinc stearate as a lubricant with respect to 100 parts by mass of each alloyed steel powder, the resulting powder was formed to ϕ11 mm and 11 mm high under a forming pressure of 686 MPa to obtain a green compact. The density of each obtained green compact was calculated from its size and weight. The density of each green compact can be regarded as an index of the compressibility of the partially diffusion-alloyed steel powder sample. From the viewpoint compressibility, those samples having a density of 7.20 $Mg/m^3$ or higher are considered acceptable.

Then, in order to evaluate the formability, each green compact was subjected to a rattler test in the same way as in Example 1 to measure its rattler value. For rattler values, 0.4% or less is considered acceptable.

The measurement results are as listed in Table 2. From these results, it can be found that the alloyed steel powder samples satisfying the conditions of the present disclosure exhibited excellent fluidity, compressibility, and formability even when the iron-based powder contained one or both of Cu and Mn.

TABLE 2

| No. | Raw material powder Number frequency of 20 μm or less (%) | Alloyed steel powder Mo content (mass %) | Cu content (mass %) | Mn content (mass %) | Solidity (—) | D50 (μm) | Fluidity | Green compact Compressibility Density ($Mg/m^3$) | Formability Rattler value (%) | Remarks |
|---|---|---|---|---|---|---|---|---|---|---|
| 21 | 60 | 0.6 | — | 0.2 | 0.85 | 73 | passed | 7.23 | 0.37 | Example |
| 22 | 59 | 0.6 | — | 0.5 | 0.84 | 72 | passed | 7.23 | 0.36 | Example |
| 23 | 60 | 0.6 | — | 0.8 | 0.85 | 75 | passed | 7.22 | 0.36 | Example |
| 24 | 60 | 0.6 | — | 1.0 | 0.85 | 75 | passed | 7.21 | 0.37 | Example |
| 25 | 60 | 0.6 | 1.5 | — | 0.83 | 74 | passed | 7.21 | 0.37 | Example |

TABLE 2-continued

| No. | Raw material powder Number frequency of 20 μm or less (%) | Alloyed steel powder Mo content (mass %) | Cu content (mass %) | Mn content (mass %) | Solidity (—) | D50 (μm) | Fluidity | Green compact Compressibility Density ($Mg/m^3$) | Formability Rattler value (%) | Remarks |
|---|---|---|---|---|---|---|---|---|---|---|
| 26 | 59 | 0.6 | 2.0 | — | 0.84 | 75 | passed | 7.22 | 0.36 | Example |
| 27 | 59 | 0.6 | 3.0 | — | 0.85 | 75 | passed | 7.24 | 0.35 | Example |
| 28 | 59 | 0.6 | 4.0 | — | 0.84 | 74 | passed | 7.25 | 0.34 | Example |
| 29 | 60 | 0.6 | 1.5 | 0.5 | 0.85 | 73 | passed | 7.21 | 0.37 | Example |
| 30 | 59 | 0.6 | 2.0 | 0.5 | 0.85 | 75 | passed | 7.22 | 0.36 | Example |
| 31 | 58 | 0.6 | 3.0 | 0.5 | 0.85 | 75 | passed | 7.24 | 0.36 | Example |
| 32 | 60 | 0.6 | 4.0 | 0.5 | 0.86 | 75 | passed | 7.25 | 0.37 | Example |
| 33 | 60 | 1.3 | 1.5 | 0.5 | 0.85 | 75 | passed | 7.21 | 0.36 | Example |
| 34 | 58 | 1.3 | 2.0 | 0.5 | 0.84 | 76 | passed | 7.22 | 0.34 | Example |
| 35 | 58 | 1.3 | 3.0 | 0.5 | 0.85 | 75 | passed | 7.24 | 0.35 | Example |
| 36 | 59 | 1.3 | 4.0 | 0.5 | 0.85 | 75 | passed | 7.25 | 0.35 | Example |
| 37 | 59 | 1.5 | 1.5 | 0.5 | 0.85 | 75 | passed | 7.20 | 0.35 | Example |
| 38 | 59 | 1.5 | 2.0 | 0.5 | 0.84 | 75 | passed | 7.21 | 0.36 | Example |
| 39 | 58 | 1.5 | 3.0 | 0.5 | 0.84 | 75 | passed | 7.23 | 0.36 | Example |
| 40 | 58 | 1.5 | 4.0 | 0.5 | 0.84 | 75 | passed | 7.24 | 0.36 | Example |

The invention claimed is:

1. A pre-alloyed steel powder comprising iron-based alloy containing Mo, wherein Mo content is 0.4 mass % to 1.8 mass %, a weight-based median size D50 is 40 μm or more, among particles contained in the alloyed steel powder, those particles having an equivalent circular diameter of 50 μm to 200 μm have a number average of solidity of 0.70 to 0.86, the solidity being defined as (particle cross-sectional area/envelope-inside area), and the number average of solidity is obtained by measuring particle cross-sectional area and envelope-inside area for at least 10,000 particles having an equivalent circular diameter of 50 μm to 200 μm through image interpretation of the projected image of each of the particles using Malvern Morphologi G3, obtaining the solidity by calculating (cross-sectional area/envelope-inside area) for each of the particles, and calculating the number average thereof.

2. The pre-alloyed steel powder according to claim 1, wherein the iron-based alloy contains Ni, Cr, and Si each in an amount of 0.1 mass % or less.

3. The pre-alloyed steel powder according to claim 1, wherein the iron-based alloy contains one or both of Cu and Mn.

4. The pre-alloyed steel powder according to claim 2, wherein the iron-based alloy contains one or both of Cu and Mn.

* * * * *